US012558722B2

(12) United States Patent
Matsumoto

(10) Patent No.: US 12,558,722 B2
(45) Date of Patent: Feb. 24, 2026

(54) INJECTION MOLDING POWDER, INJECTION MOLDING POWDER PRODUCTION METHOD, AND METAL SINTERED COMPACT PRODUCTION METHOD

(71) Applicant: SEIKO EPSON CORPORATION, Tokyo (JP)

(72) Inventor: Yasutaka Matsumoto, Suwa (JP)

(73) Assignee: SEIKO EPSON CORPORATION (JP)

( * ) Notice: Subject to any disclaimer, the term of this patent is extended or adjusted under 35 U.S.C. 154(b) by 0 days.

(21) Appl. No.: 18/170,880

(22) Filed: Feb. 17, 2023

(65) Prior Publication Data

US 2023/0264258 A1 Aug. 24, 2023

(30) Foreign Application Priority Data

Feb. 18, 2022 (JP) ..... 2022-023683

(51) Int. Cl.

| | |
|---|---|
| ***B22F 1/102*** | (2022.01) |
| ***B22F 1/05*** | (2022.01) |
| ***B22F 3/22*** | (2006.01) |

(52) U.S. Cl.

CPC ..... *B22F 1/102* (2022.01); *B22F 1/05* (2022.01); *B22F 3/225* (2013.01); *B22F 2304/10* (2013.01); *B22F 2998/10* (2013.01)

(58) Field of Classification Search

CPC ..... B22F 1/102; C23C 8/06

See application file for complete search history.

(56) References Cited

U.S. PATENT DOCUMENTS

| | | | | |
|---|---|---|---|---|
| 7,943,084 | B1 * | 5/2011 | Johnson | B22F 1/102 419/30 |
| 8,988,301 | B2 * | 3/2015 | Yonetsu | H01F 41/0246 343/787 |
| 2004/0216811 | A1 * | 11/2004 | Ikegami | H01F 1/0578 148/105 |
| 2014/0077132 | A1 | 3/2014 | Ijiro et al. | |
| 2014/0349061 | A1 * | 11/2014 | Sikka | B29C 37/0032 428/98 |

(Continued)

FOREIGN PATENT DOCUMENTS

| | | | | |
|---|---|---|---|---|
| CN | 106189832 A | * 12/2016 | | B05D 7/24 |
| CN | 110951289 A | * 4/2020 | | |

(Continued)

OTHER PUBLICATIONS

Nanoslic; "Oleophobicity Coatings"; retrieved from internet on Oct. 4, 2023; https://nanoslic.com/oleophobic-coatings/ (Year: 2023).*

(Continued)

*Primary Examiner* — Alexandra M Moore
*Assistant Examiner* — Austin Pollock
(74) *Attorney, Agent, or Firm* — Harness, Dickey & Pierce, P.L.C.

(57) ABSTRACT

An injection molding powder includes a metal powder, and a film with which a particle surface of the metal powder is coated and which contains a fluorine compound, in which a contact angle of hexadecane measured at 25° C. by a θ/2 method is 60° or more and 110° or less in a state in which the injection molding powder is laid in layers.

5 Claims, 2 Drawing Sheets

(56) References Cited

U.S. PATENT DOCUMENTS

| | | | | |
|---|---|---|---|---|
| 2015/0183965 | A1* | 7/2015 | Stucchi | B32B 27/32 264/405 |
| 2015/0243973 | A1 | 8/2015 | Newbound et al. | |
| 2015/0263342 | A1 | 9/2015 | Newbound et al. | |
| 2017/0157842 | A1* | 6/2017 | Sato | B22F 10/34 |
| 2017/0338476 | A1 | 11/2017 | Newbound et al. | |
| 2018/0237627 | A1 | 8/2018 | Liu et al. | |
| 2019/0127500 | A1 | 5/2019 | Liu et al. | |
| 2020/0247923 | A1 | 8/2020 | Liu et al. | |
| 2021/0013491 | A1 | 1/2021 | Newbound et al. | |
| 2022/0243034 | A1* | 8/2022 | Inoue | B29C 45/02 |
| 2022/0250145 | A1 | 8/2022 | Wakabayashi et al. | |

FOREIGN PATENT DOCUMENTS

| | | | | | |
|---|---|---|---|---|---|
| CN | 111825936 | A | * | 10/2020 | C08K 3/08 |
| JP | 63306603 | A | * | 12/1988 | |
| JP | H01-176007 | A | | 7/1989 | |
| JP | H01-215907 | A | | 8/1989 | |
| JP | H066728 | B2 | * | 1/1994 | |
| JP | H-618130 | B2 | * | 3/1994 | C08K 5/54 |
| JP | H11-158503 | A | | 6/1999 | |
| JP | 2001176711 | A | * | 6/2001 | H01F 41/0253 |
| JP | 2004304069 | A | * | 10/2004 | |
| JP | 5682741 | B2 | * | 3/2015 | |
| JP | 2017-002358 | A | | 1/2017 | |
| JP | 2017-025392 | A | | 2/2017 | |
| JP | 2017-513787 | A | | 6/2017 | |
| JP | 2018135547 | A | * | 8/2018 | |
| JP | 2019-511616 | A | | 4/2019 | |
| JP | 2019104954 | A | * | 6/2019 | |
| JP | 2022-122503 | A | | 8/2022 | |
| WO | WO-2009003847 | A1 | * | 1/2009 | C08J 7/06 |
| WO | 2012-115151 | A1 | | 8/2012 | |
| WO | WO-2017159366 | A1 | * | 9/2017 | |
| WO | WO-2023140014 | A1 | * | 7/2023 | C08L 77/06 |
| WO | WO-2023157139 | A1 | * | 8/2023 | B22F 1/102 |

OTHER PUBLICATIONS

Arkles B., "Hydrophobicity, Hydrophilicity, and Silane", Paintings and Coatings, 2006 (Year: 2006).*

Britannica; Hydrolysis; https://www.britannica.com/science/hydrolysis, Retrieved on Nov. 13, 2024 (Year: 2024).*

GM Chemix; "nonafluorohexyltrimethoxysilane", https://www.gmchemix.com/product-nonafluorohexyltrimethoxysilane-cas-85877-79-8.html; retrieved on Nov. 13, 2024, Wayback machine date Jul. 31, 2021 (Year: 2021).*

* cited by examiner

INJECTION MOLDING POWDER, INJECTION MOLDING POWDER PRODUCTION METHOD, AND METAL SINTERED COMPACT PRODUCTION METHOD

The present application is based on, and claims priority from JP Application Serial Number 2022-023683, filed Feb. 18, 2022, the disclosure of which is hereby incorporated by reference herein in its entirety.

BACKGROUND

1. Technical Field

The present disclosure relates to an injection molding powder, an injection molding powder production method, and a metal sintered compact production method.

2. Related Art

In recent years, additive manufacturing methods using metal powders are widespread as a technique for manufacturing three-dimensional objects. This technique is a technique of manufacturing a three-dimensional object including a step of calculating a cross-sectional shape of a three-dimensional object obtained by thinly slicing the three-dimensional object on a plane orthogonal to a manufacturing direction, a step of forming a powder layer by layering a metal powder, and a step of solidifying a part of the powder layer based on the shape obtained by the calculation, in which the step of forming a powder layer and the step of solidifying a part of the powder layer are repeated.

A fused deposition modeling (FDM) method, a selective laser sintering (SLS) method, a binder jet method, and the like are known as methods for manufacturing a three-dimensional object, which have different principles of solidification.

As a modification of the selective laser sintering method, JP-A-2017-25392 discloses a method for producing an EB sintering type 3D printer product using electron beams (EB) instead of lasers. This method is a method for producing a metal molded product by manufacturing a surface-treated metal powder for an EB sintering type 3D printer, preheating the metal powder if desired, and then sintering the metal powder by EB irradiation. The surface-treated metal powder for the EB sintering type 3D printer is a powder obtained by subjecting the surface of the metal powder produced by a known method to a surface treatment with a coupling agent. By using such a metal powder subjected to the surface treatment, conductivity during manufacturing is improved. Therefore, the metal powder can be suitably sintered by EB. Partial sintering due to preheating can also be prevented.

However, the surface-treated metal powder disclosed in JP-A-2017-25392 has a problem that fluidity thereof decreases at a high temperature or during moisture absorption.

On the other hand, in the fused deposition modeling method, a metal powder and a binder are mixed, and the mixture is injected to obtain a three-dimensional shaped body. Therefore, there is an advantage that fluidity of the mixture is easily secured by the binder. In addition, a metal sintered compact can be obtained by subjecting the produced three-dimensional shaped body to a debindering treatment and a sintering treatment.

However, depending on a shape and shaping conditions of the three-dimensional shaped object to be produced, it is necessary to sufficiently increase the fluidity of the compound. Therefore, it is necessary to mix a large amount of binder in the compound. The binder is removed when the three-dimensional shaped body is subjected to a debindering step or a sintering step after the production of the three-dimensional shaped body, and accordingly, shrinkage occurs in the three-dimensional shaped body. Such shrinkage causes a decrease in dimensional accuracy of the sintered compact when the three-dimensional shaped body is sintered.

As a used amount of the binder increases, a shrinkage amount also increases, and therefore, it is an object to reduce the used amount of the binder while securing the fluidity of the compound.

SUMMARY

An injection molding powder according to an application example of the present disclosure includes: a metal powder; and a film with which a particle surface of the metal powder is coated and which contains a fluorine compound, in which a contact angle of hexadecane measured at 25° C. by a θ/2 method is 60° or more and 110° or less in a state in which the injection molding powder is laid in layers.

An injection molding powder production method according to an application example of the present disclosure includes: mixing the metal powder and a fluorine compound powder containing a fluorine compound, and mechanically adhering the fluorine compound powder to the particle surface of the metal powder to form the film, thereby producing an injection molding powder.

An injection molding powder production method according to an application example of the present disclosure includes: mixing the metal powder and a monomer gas, and causing a polymerization reaction in the monomer gas on the particle surface of the metal powder and generating the fluorine compound to form the film, thereby producing an injection molding powder.

An injection molding powder production method according to an application example of the present disclosure includes: mixing the metal powder and a fluorine compound precursor, and polymerizing the fluorine compound precursor on the particle surface of the metal powder and generating the fluorine compound to form the film, thereby producing an injection molding powder.

A metal sintered compact production method according to an application example of the present disclosure includes: mixing the injection molding powder according to the application example of the present disclosure and an organic binder to prepare an injection molding composition; subjecting the injection molding composition to injection molding to obtain an injection molded body; and subjecting the injection molded body to a sintering treatment.

DESCRIPTION OF EXEMPLARY EMBODIMENTS

Hereinafter, an injection molding powder, an injection molding powder production method, and a metal sintered compact production method according to the present disclosure will be described in detail with reference to the accompanying drawings.

1. Injection Molding Powder

First, the injection molding powder according to the embodiment will be described. The injection molding powder refers to, for example, a metal powder used in a metal powder injection molding method (MIM method), a fused deposition modeling method (metal FDM method) using a metal powder, or the like. Since the MIM method and the metal FDM method are common in that a compound containing a metal powder and an organic binder is injected to obtain a molded body, these methods are also collectively referred to as an "injection molding method" in the present specification.

Figure 1:
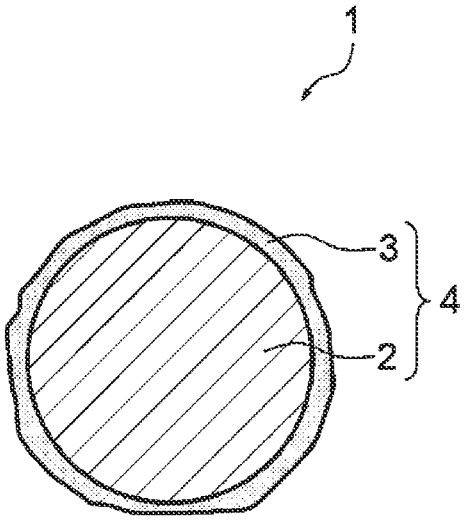
FIG. 1 is a cross-sectional view schematically showing one particle of an injection molding powder according to an embodiment.

FIG. 1 is a cross-sectional view schematically showing one particle of an injection molding powder 1 according to the embodiment. In the following description, the one particle of the injection molding powder 1 is also referred to as an "injection molding particle 4".

The injection molding particle 4 shown in FIG. 1 includes a metal particle 2 and a film 3 provided on a surface of the metal particle 2. The film 3 is provided to coat the surface of the metal particle 2, and contains a fluorine compound. The term "coat" in the present specification refers to a concept that includes a state in which a part of the surface of the metal particle 2 is covered, as well as a state in which the entire surface of the metal particle 2 is covered. In addition, in the following description, an aggregate of metal particles 2 is also referred to as a "metal powder".

In such an injection molding powder 1, since it is possible to prevent an excessive increase in affinity for an organic binder, it is possible to secure fluidity of the compound even when a used amount of the organic binder is reduced. Accordingly, when the compound is molded by the injection molding method, a density of the injection molding powder 1 in the molded body can be increased. As a result, it is possible to obtain a molded body having a small shrinkage amount due to debindering, and it is possible to prevent a decrease in dimensional accuracy of a finally obtained metal sintered compact.

1.1. Metal Particle

A constituent material of the metal particle 2 is not particularly limited, and may be any material as long as the material is a metal material having sinterability. Examples of the constituent material of the metal particle 2 include simple substances such as Fe, Ni, Co, and Ti, and alloys and intermetallic compounds containing these simple substances as main components.

Examples of Fe-based alloys include stainless steels such as an austenitic stainless steel, a martensitic stainless steel, and a precipitation hardening stainless steel, low carbon steels, carbon steels, heat resistant steels, die steels, high speed tool steels, Fe—Ni-based alloys, and Fe—Ni—Co-based alloys.

Examples of Ni-based alloys include Ni—Cr—Fe-based alloys, Ni—Cr—Mo-based alloys, and Ni—Fe-based alloys.

Examples of Co-based alloys include Co—Cr-based alloys, Co—Cr—Mo-based alloys, and Co—Al—W-based alloys.

Examples of Ti-based alloys include alloys of Ti and metal elements such as Al, V, Nb, Zr, Ta, and Mo, and specifically, Ti-6Al-4V and Ti-6Al-7Nb.

An average particle diameter of the metal powder is preferably 3.0 μm or more and 30.0 μm or less, and more preferably 5.0 μm or more and 15.0 μm or less. Accordingly, a filling property of the metal powder can be particularly improved during injection molding, and a molded body having a small shrinkage amount can be obtained. As a result, a metal sintered compact having high dimensional accuracy is obtained.

The average particle diameter of the metal powder is a particle diameter where a cumulative frequency from a small diameter side is 50% in a cumulative particle size distribution on a volume basis of the metal powder obtained by a laser diffraction method.

1.2. Film

The surface of the metal particle 2 is coated with the film 3. The film 3 contains a fluorine compound. Since the fluorine compound has low surface free energy, the fluorine compound exhibits not only water repellency but also oil repellency. Therefore, the film 3 containing the fluorine compound has low affinity for an organic binder. As a result, when the injection molding particle 4 is kneaded with the organic binder, a viscosity of the injection molding particle 4 is less likely to increase. Therefore, the injection molding particle 4 exhibits good fluidity even when being kneaded with a small amount of the organic binder.

In addition, since the fluorine compound is rich in water repellency, the injection molding powder 1 is excellent in moisture resistance. Accordingly, it is possible to prevent rust development of the metal particle 2 due to moisture absorption. As a result, it is possible to prevent deterioration of characteristics of a metal sintered compact due to the rust development.

The fluorine compound is not particularly limited as long as the compound contains a fluorine atom. Examples of the fluorine compound include various fluororesins such as fully fluorinated resins (such as polytetrafluoroethylene resin (PTFE)), partially fluorinated resins (such as polyvinylidene fluoride (PVF) and polychlorotrifluoroethylene (PCTFE)), and copolymers such as a tetrafluoroethylene-perfluoroalkyl vinyl ether resin (PFA), a fluorinated ethylene propylene resin (FEP), a hexafluoroethylene propylene resin (PFEP), and an ethylene/tetrafluoroethylene copolymer (E/TFE). One or a mixture of two or more thereof is used.

In addition, the fluorine compound may be a coupling agent containing a fluorine atom, or a compound derived from a metal alkoxide containing a fluorine atom. Examples of the coupling agent containing a fluorine atom include a fluoroalkylsilane and a fluoroarylsilane.

In addition, since the fluorine compound has a low Young's modulus, the fluorine compound has an advantage that a coverage of the compound on the surface of the metal particle 2 is easily increased. Therefore, the film 3 containing the fluorine compound can achieve both a thinner film thickness and a higher coverage. Then, a compound in which not only a ratio of the organic binder but also a ratio of the film 3 is reduced can be implemented.

The Young's modulus of the fluorine compound is preferably 3.0 GPa or less, more preferably 0.05 GPa or more and 2.0 GPa or less, and still more preferably 0.1 GPa or more and 1.0 GPa or less. By using the fluorine compound having such a Young's modulus, the coverage of the film 3 with respect to the surface of the metal particle 2 can be particularly increased, and it is easy to make the film thickness of the film 3 thinner and more uniform. Accordingly, an occupancy rate of the metal powder in the compound can be further increased without impairing the fluidity of the compound. When the Young's modulus exceeds the upper limit value, rigidity of the film 3 is increased, and thus the film 3 may easily be peeled off. On the other hand, the Young's modulus may be lower than the lower limit value, but the rigidity of the film 3 becomes excessively low, and thus the film 3 may easily be peeled off in this case as well.

The film 3 may contain a component other than the fluorine compound. Examples of the component other than the fluorine compound include an organic material other than the fluorine compound, and an inorganic material such as a glass material or a ceramic material. A content of the component other than the fluorine compound in the film 3 is preferably 30 mass % or less, and more preferably 10 mass % or less.

In addition, the film 3 may be implemented by a plurality of layers as long as the film 3 includes a layer containing the fluorine compound. From the viewpoint of easy peeling-off between layers and difficulty in reducing the film thickness, it is preferable that the film 3 is implemented by a single layer.

An average thickness of the film 3 is preferably 3 nm or more and 100 nm or less, more preferably 5 nm or more and 30 nm or less, and still more preferably 5 nm or more and 10 nm or less. Accordingly, the coverage of the film 3 can be sufficiently secured, and adverse effects caused by the film 3 being excessively thick can be prevented. When the average thickness of the film 3 is less than the lower limit value, the coverage of the film 3 may be insufficient depending on a constituent material of the film 3. On the other hand, when the average thickness of the film 3 exceeds the upper limit value, the film 3 may easily be peeled off, or the occupancy rate of the metal particle 2 in the compound may decrease depending on the constituent material of the film 3.

The average thickness of the film 3 is measured, for example, by observing a cross section of the injection molding particle 4 in an enlarged manner. Specifically, the injection molding particle 4 is cut by a focused ion beam so as to prepare a thin section sample. Next, the obtained thin section sample is observed with a scanning transmission electron microscope, and the thickness of the film 3 is measured at five or more positions for one particle. Then, measured values are averaged, and a calculation result thereof is taken as the average thickness of the film 3. A range of the film 3 can be confirmed by, for example, energy-dispersive X-ray spectroscopy (EDX analysis) or Auger electron spectroscopy measurement.

The oil repellency of the film 3 may be adjusted by subjecting the surface of the film 3 to a hydrophilization treatment. On the surface of the film 3 subjected to the hydrophilization treatment, it is conceivable that a hydroxy group is introduced instead of a fluorine atom contained in the fluorine compound. It is conceivable that this hydroxy group provides hydrophilicity. Therefore, when the fluidity of the compound becomes excessively high, the fluidity can be adjusted by subjecting the surface of the film 3 to the hydrophilization treatment.

Examples of the hydrophilization treatment include a plasma treatment, an ozone treatment, a corona treatment, and an ultraviolet irradiation treatment. In particular, it is preferable that the plasma treatment or the ozone treatment is used. Accordingly, the hydrophilization can be efficiently performed at a high density. Examples of a treatment gas in the plasma treatment include water vapor, oxygen, argon, and nitrogen.

The coverage of the film 3 on the surface of the metal particle 2 is preferably 40% or more, and more preferably 60% or more and 95% or less. Accordingly, when the injection molding powder 1 is kneaded with an organic binder, an area in which the metal particle 2 is in direct contact with the organic binder can be reduced. As a result, the viscosity generated between the metal particle 2 and the organic binder is reduced, and the fluidity of the compound can be further improved. Although the coverage may exceed the upper limit value, the coverage is preferably equal to or less than the upper limit value from the viewpoint that the injection molding powder 1 having a stable coverage can be easily produced.

The coverage of the film 3 can be identified by a surface-sensitive elemental analysis method such as elemental analysis using an X-ray photoelectron spectroscopy (XPS) method. Specifically, a ratio of an element inherent in the metal particle 2 is measured by the elemental analysis using the XPS method on a surface of the injection molding particle 4. Next, the film 3 is removed by a treatment of removing the film 3. Examples of this treatment include a liquid phase treatment using a liquid for dissolving the film 3, and a gas phase treatment for decomposing and removing the film 3. By removing the film 3, the surface of the metal particle 2 is exposed. Next, the surface of the metal particle 2 is again subjected to the elemental analysis using the XPS method, and the ratio of the element inherent in the metal particle 2 is calculated. Here, as an example, it is assumed that a ratio of Si is measured based on a peak area ratio of a Si2p peak obtained by the elemental analysis using the XPS method. Then, when the ratio of Si after the treatment is set as 100, a relative value X of the ratio of Si before the treatment is calculated. Then, a value of 100-X corresponds to an amount of Si in the metal particle 2 coated with the film 3. As a result, 100-X can be the coverage of the film 3.

The oil repellency of the film 3 depends mainly on a concentration of fluorine atoms in the fluorine compound. The concentration of fluorine atoms is calculated based on an area ratio between an F1s peak and another peak by performing the elemental analysis using the XPS method on the film 3. The area ratio of the F1s peak calculated by this method is preferably 10% or more and 75% or less, more preferably 30% or more and 60% or less, and still more preferably 35% or more and 55% or less of a total peak area. Accordingly, the film 3 contains the fluorine atoms at a sufficient concentration. As a result, it is possible to further reduce the used amount of the organic binder necessary for securing the fluidity of the compound.

The injection molding powder 1 including the film 3 is kneaded with an organic binder so as to be compounded. The obtained compound is subjected to injection molding, and the obtained molded body is debindered and sintered to obtain a metal sintered compact. At this time, in the fluorine compound contained in the film 3, fluorine atoms are diffused into a deep portion of the metal particle 2 due to heating during the injection molding or debindering, so that adhesion between the metal particle 2 and the film 3 is further improved. In addition, since the film 3 is interposed between adjacent metal particles 2, a bonding force between the metal particles 2 is increased. As a result, shape retainability of the molded body and a debindered body can be further improved.

1.3. Contact Angle

The oil repellency of the injection molding powder 1 can be evaluated based on a contact angle of a liquid measured in a state in which the injection molding powder 1 is laid in layers. The contact angle can be measured by the following procedure.

First, a double-sided tape is attached to a flat surface. Next, the injection molding powder 1 is laid on the double-sided tape. Then, the laid injection molding powder 1 is lightly pressed by a plate-shaped member. Next, extra injection molding powder 1 is blown off with an air blower. Accordingly, a test piece for the contact angle measurement is obtained.

Next, a contact angle of hexadecane with respect to the test piece is measured by a θ/2 method using a contact angle measuring device, Drop Master 500, manufactured by Kyowa Interface Science Co., Ltd. Measurement conditions include a temperature of 25° C. and a relative humidity of 50%±5%. In addition, a metal powder having an average particle diameter of 7 μm is used, a dropping amount of hexadecane is set to 3 μL, and the measurement is performed 5 seconds after drop adhesion.

The contact angle of hexadecane measured for the injection molding powder 1 laid in layers is 600 or more and 1100 or less. By exhibiting such a contact angle with respect to hexadecane, an increase in viscosity of the injection molding powder 1 can be prevented even when the injection molding powder 1 is kneaded with an organic binder. That is, the injection molding powder 1 exhibits an appropriate viscosity even when being kneaded with an organic binder so as to achieve both the shape retainability necessary for the molded body and the fluidity necessary for the compound.

When the contact angle of hexadecane is less than the lower limit value, the oil repellency decreases, and thus the viscosity of the injection molding powder 1 with respect to the organic binder increases, and the fluidity of the compound decreases. On the other hand, when the contact angle of hexadecane exceeds the upper limit value, the oil repellency becomes excessively high, and thus the injection molding powder 1 is difficult to disperse in the organic binder. As a result, homogeneity of the compound is reduced.

The contact angle is preferably 70° or more and 105° or less, more preferably 800 or more and 1000 or less, and still more preferably 850 or more and 1000 or less.

1.4. Viscosity of Mixture of Injection Molding Powder and Organic Binder

When the injection molding powder 1 is kneaded with an organic binder to prepare a compound, the fluidity of the compound can be improved. The fluidity can be evaluated based on, for example, a viscosity of a mixture of the injection molding powder 1 and a polystyrene. The viscosity of the mixture can be measured by the following procedure. First, an amount of the polystyrene corresponding to 7 volume % of the injection molding powder 1 is added to the injection molding powder 1 to prepare the mixture. Next, the mixture is stirred until the mixture becomes uniform. Then, the viscosity of the stirred mixture is measured with a rheometer while changing a shear rate applied to the mixture. As the rheometer, for example, a dynamic viscoelasticity measuring device ARES-G2 manufactured by TA Instruments Japan Inc., or the like is used. A sample temperature during the measurement is 20° C., a measurement mode is a rotation mode, and a parallel plate is used for geometry. Next, a curve (flow curve) indicating a change in viscosity with respect to a change in shear rate is acquired.

When a viscosity at a shear rate of 0.5 [l/s] is defined as a "viscosity at a low shear rate", the viscosity at the low shear rate of the mixture containing the injection molding powder 1 is preferably 20 [Pa·s] or more, more preferably 50 [Pa·s] or more and 2000 [Pa·s] or less, and still more preferably 100 [Pa·s] or more and 1000 [Pa·s] or less. Accordingly, the compound containing the injection molding powder 1 is less likely to flow during storage or after molding in which almost no shear rate is applied. As a result, a leakage and sagging during the storage can be prevented, and the shape retainability of the injection molded body can be improved.

When a viscosity at a shear rate of 500 [l/s] is defined as a "viscosity at a high shear rate", the viscosity at the high shear rate of the mixture containing the injection molding powder 1 is preferably 0.5 [Pa·s] or less, more preferably 0.001 [Pa·s] or more and 0.3 [Pa·s] or less, and still more preferably 0.01 [Pa·s] or more and 0.1 [Pa·s] or less. Accordingly, the compound containing the injection molding powder 1 exhibits high fluidity during the injection molding in which a shear rate is applied.

In addition, a rate of change in viscosity [Pa·s](a proportion of an amount of change in viscosity to an amount of change in shear rate) when the shear rate is increased from 0.5 [l/s] to 500 [l/s] is calculated. In the mixture containing the injection molding powder 1, the rate of change in viscosity with respect to the change in shear rate is preferably 0.05 or more and 10.0 or less, more preferably 0.3 or more and 5.0 or less, and still more preferably 0.5 or more and 2.0 or less. When the rate of change in viscosity with respect to the change in shear rate is within the above range, a slope of the flow curve becomes sufficiently large, and thus the viscosity of the mixture can satisfy the above range both at the low shear rate and at the high shear rate. That is, the compound containing the injection molding powder 1 has a high viscosity at the low shear rate such as during the storage or after the molding, and is likely to prevent the leakage or sagging during storage, deformation of the injection molded body, and the like. In addition, the compound containing the injection molding powder 1 exhibits a high fluidity at the high shear rate such as during the injection molding. Therefore, by using the injection molding powder 1, moldability of the compound can be improved while improving a handling property of the compound, and the shape retainability of the injection molded body can be improved. As a result, the injection molding powder 1 eventually contributes to the production of the metal sintered compact having high dimensional accuracy.

1.5. Effects of Embodiment

As described above, the injection molding powder 1 according to the embodiment includes the metal powder 2 and the film 3 with which the particle surface of the metal powder (the surface of the metal particle 2) is coated and which contains the fluorine compound. In the injection molding powder 1, the contact angle of hexadecane measured at 25° C. by the θ/2 method is 60° or more and 110° or less in a state in which the injection molding powder 1 is laid in layers.

According to such a configuration, even when the injection molding powder 1 is kneaded with an organic binder, an increase in viscosity is prevented. Accordingly, when the injection molding powder 1 and the organic binder are kneaded to prepare a compound, the fluidity of the compound can be secured even when the used amount of the organic binder is reduced. As a result, when the compound is molded by the injection molding method, the density of the injection molding powder 1 in a molded body can be increased, and a molded body having a small shrinkage amount due to debindering can be obtained. Therefore, eventually, a metal sintered compact having high dimensional accuracy can be produced.

In addition, in the injection molding powder 1 according to the embodiment, the average particle diameter of the metal powder is preferably 3.0 μm or more and 30.0 μm or less.

Accordingly, the filling property of the metal powder can be particularly improved during the injection molding of the compound, and a molded body having a small shrinkage amount can be obtained. As a result, a metal sintered compact having high dimensional accuracy is obtained.

In addition, in the injection molding powder 1 according to the embodiment, the area ratio of the F1s peak detected by the X-ray photoelectron spectroscopy (XPS) method is preferably 10% or more and 75% or less of the total peak area.

Accordingly, the film 3 contains the fluorine atoms at a sufficient concentration. As a result, it is possible to further reduce the used amount of the organic binder necessary for securing the fluidity of the compound.

In addition, in the injection molding powder 1 according to the embodiment, when the viscosity of the mixture obtained by mixing the injection molding powder 1 with a polystyrene is measured with the rheometer while changing the shear rate, the rate of change in viscosity with respect to the amount of change in shear rate is preferably 0.05 or more and 10.0 or less.

Accordingly, since the slope of the flow curve indicating the change in viscosity with respect to the change in shear rate becomes large, it is possible to improve the fluidity of the compound during the injection molding while preventing the leakage and sagging during the storage of the compound and improving the shape retainability of the molded body. As a result, eventually, a metal sintered compact having high dimensional accuracy can be obtained.

2. Injection Molding Powder Production Method

Next, the injection molding powder production method according to the embodiment will be described.

Figure 2:
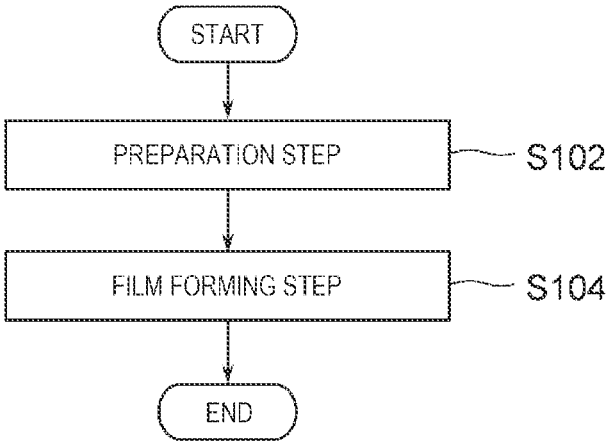
FIG. 2 is a process diagram showing an injection molding powder production method according to the embodiment.

FIG. 2 is a process diagram showing the injection molding powder production method according to the embodiment.

The injection molding powder production method shown in FIG. 2 includes a preparation step S102 and a film forming step S104.

2.1. Preparation Step

In the preparation step S102, a metal powder is prepared. The metal powder may be a powder produced by any method. Examples of the production method include various atomization methods such as a water atomization method, a gas atomization method, and a rotary water flow atomization method, a reduction method, a carbonylation method, and a pulverization method. Among these, the atomization method is preferably used. That is, the metal powder is preferably an atomized powder. The atomized powder is minute, has high sphericity, and has high production efficiency. In addition, in particular, since a water atomized powder or a rotary water flow atomized powder is produced by contact between a molten metal and water, there is a thin oxide film on a surface thereof. This oxide film can serve as a base of the film 3. Therefore, the adhesion between the metal particle 2 and the film 3 can be improved.

When a commercially available metal powder or the like is procured, this step can be omitted.

2.2. Film Forming Step

In the film forming step S104, the film 3 with which the surface of the metal particle 2 is coated is formed. Accordingly, the injection molding powder 1 is obtained.

A method for forming the film 3 is not particularly limited, and examples thereof include dry forming methods such as a mechanochemical method, a plasma polymerization method, an atomic layer deposition (ALD) method, a chemical vapor deposition (CVD) method, and an ion plating method, and wet forming methods such as a sol-gel method and an electrolytic reduction method.

Hereinafter, the mechanochemical method, the plasma polymerization method, and the sol-gel method will be sequentially described as representatives.

2.2.1. Mechanochemical Method

The mechanochemical method is a method in which mechanical stress is applied to a particle to change physicochemical properties of the particle. For example, when mechanical interaction (mechanochemical reaction) is caused between the metal particle 2 and a raw material of the film 3 by using a mechanochemical reaction device that includes a compression tool and a blade therein and includes a cylindrical chamber rotating at a high speed, the film 3 can be formed at the surface of the metal particle 2. Therefore, the mechanochemical method is used as the method for forming the film. Specifically, first, the metal particle 2 and the raw material of the film 3 are charged into the chamber. Examples of the raw material of the film 3 include a fluorine compound powder and other additives. When the chamber is rotated, these charged materials collide with each other or are pressed against an inner wall of the chamber. As a result, the raw material of the film 3 is pressed against the surface of the metal particle 2 to form a film. In this manner, the injection molding particle 4 is obtained. In addition, by using such a mechanical film forming method, even when a contaminant adheres to the surface of the metal particle 2, when an adhesion force is low, or when surface roughness is low, the film 3 can favorably adhere to the surface of the metal particle 2. Further, since the metal particle 2 does not undergo any high temperature state in the process of forming the film 3, thermal denaturation of the metal particle 2, for example, unintended crystal coarsening can be prevented. Accordingly, it is possible to prevent a decrease in mechanical properties of the metal particle 2.

In addition, as described above, the fluorine compound has a lower Young's modulus than other resin materials and inorganic materials. Therefore, by using the mechanochemical method, the film 3 that is thin and has a high coverage can be efficiently formed.

Examples of the mechanochemical reaction device include a "Nobilta" (registered trademark) pulverizer and a "Mechanofusion" (registered trademark) pulverizer manufactured by Hosokawa Micron Ltd., and a "Hybridizer" (registered trademark) pulverizer manufactured by Nara Machinery Co., Ltd.

Examples of the fluorine compound powder include powders of the various fluororesins described above, and one or a mixture of two or more thereof is used. Among these, the fluororesin constituting the fluorine compound powder is preferably PTFE or PFA. These fluororesins have particularly low surface free energy, thereby exhibiting high oil repellency. Therefore, by using the powders of these fluororesins as the fluorine compound powder, it is possible to further reduce the used amount of the organic binder during the preparation of the compound.

An average particle diameter of the fluorine compound powder is not particularly limited, and is preferably 0.2 times or more and 5.0 times or less, more preferably 0.5 times or more and 2.0 times or less, and still more preferably 0.7 times or more and 1.5 times or less the average particle diameter of the metal powder. Accordingly, the metal powder and the fluorine compound powder are mixed more uniformly, and thus the film thickness of the film 3 can be uniform.

In addition, the average particle diameter of the fluorine compound powder is preferably 0.1 μm or more and 100 μm or less, more preferably 3 μm or more and 50 μm or less, and still more preferably 5 μm or more and 10 μm or less.

The average particle diameter of the fluorine compound powder is a particle diameter where a cumulative frequency from a small diameter side is 50% in a particle size distribution on a volume basis obtained by the laser diffraction method.

A charged amount of the raw material of the film 3 is appropriately adjusted according to the film thickness of the film 3 to be formed. As an example, the charged amount of the raw material of the film 3 is preferably 0.1 mass % or more, and more preferably 0.4 mass % or more of the metal powder. Even if the amount of the raw material of the film 3 is large, an upper limit value thereof may not be particularly set since the raw material adhering to the surface of the metal particle 2 is limited. However, in consideration of the fact that energy of mixing is reliably transmitted to the surface of the metal particle 2, the charged amount of the raw material of the film 3 is preferably 3.0 mass % or less, and more preferably 1.0 mass % or less of the metal powder.

As described above, the injection molding powder production method according to the embodiment includes the film forming step S104 in which the mechanochemical reaction is used. In the film forming step S104 according to the embodiment, the metal powder and the fluorine compound powder that contains the fluorine compound are mixed, and the fluorine compound powder mechanically adheres to the particle surface of the metal powder (the surface of the metal particle 2). Accordingly, the film 3 with which the surface of the metal particle 2 is coated is formed, and the injection molding powder 1 is produced.

According to such a production method, since the mechanochemical reaction is used, even when a contaminant adheres to the surface of the metal particle 2, when an adhesion force is low, or when surface roughness is low, the film 3 can favorably adhere to the surface of the metal particle 2. Therefore, according to the production method, the injection molding powder 1 can be efficiently produced.

In the injection molding powder production method according to the embodiment, the fluorine compound powder is a PTFE powder or a PFA powder. The fluororesin constituting these fluororesin powders has particularly low surface free energy, thereby exhibiting high oil repellency. Therefore, by using the powders of these fluororesins as the fluorine compound powder, it is possible to further reduce the used amount of the organic binder during the preparation of the compound.

2.2.2. Plasma Polymerization Method

The plasma polymerization method is a method for forming a film by generating plasma discharge in a state in which a monomer gas is introduced and depositing a polymer on a surface of an object to be treated.

A fluorine-containing gas is used as the monomer gas. Examples of the fluorine-containing gas include a $CHF_3$ gas, a $C_4F_8$ gas, a $C_4F_{10}$ gas, and Fluorinert (registered trademark). Examples of the Fluorinert include $C_5F_{12}$, $C_6F_{14}$, and $C_7F_{16}$. When the Fluorinert is a liquid, the Fluorinert is gasified and used.

In addition, an additive gas (crosslinking gas) serving as a crosslinking agent may be used. The crosslinking gas crosslinks monomers in a process of plasma polymerization. Therefore, the crosslinking gas is preferably added when a molecular weight of the monomer gas is high. By adding the crosslinking gas, even if the monomer gas moves slowly and a probability of reaction occurrence at an active site is low, it is possible to compensate for the above, and it is possible to promote the plasma polymerization. Examples of the crosslinking gas include a fluoroalkane gas having 3 or less carbon atoms. Specific examples thereof include a $CF_4$ gas, a $C_2F_5$ gas, and a $C_3F_8$ gas.

When a gas having a double bond in a molecule, such as a $C_4F_8$ gas, is used as the monomer gas, or when activity of the monomer gas is high, the addition of the crosslinking gas may be omitted.

Further, examples of a discharge gas include rare gases such as He and Ar, and a nitrogen gas.

In addition, examples of the additive gas used in the polymerization reaction include hydrocarbon gases such as methane, ethane, propane, and butane, halogen, oxygen, hydrogen, $NF_3$, $SF_6$, and $CF_4$.

Components other than the monomer gas may be added as necessary, and may be omitted.

When these gases are introduced into a chamber of a plasma polymerization device and the plasma discharge is generated, the monomer gas reaches the surface of the metal particle 2 that is the object to be treated. Then, the polymerization reaction occurs in the monomer gas due to an active species contained in a plasma, and the film 3 is formed.

A driving force for causing the polymerization reaction in the monomer gas is not limited to the plasma discharge, and may also be, for example, ultraviolet irradiation. However, the plasma discharge is preferable from the viewpoint that the film 3 can thus be formed to be dense. Since the dense film 3 is hard, the film 3 is not easily broken even if the film 3 is thin. Accordingly, the occupancy rate of the metal powder in the compound can be further increased.

As described above, the injection molding powder production method according to the embodiment includes the film forming step S104 implemented by the method for polymerizing the monomer gas. In the film forming step S104 according to the embodiment, the metal powder and the monomer gas are mixed to cause the polymerization reaction in the monomer gas on the particle surface of the metal powder (the surface of the metal particle 2), thereby generating the fluorine compound. Accordingly, the film 3 with which the surface of the metal particle 2 is coated is formed, and the injection molding powder 1 is produced.

According to such a production method, the film 3 having a uniform film thickness and a high coverage can be formed by the monomer gas flowing around. Therefore, according to the production method, the injection molding powder 1 capable of further increasing the occupancy rate of the metal powder in the compound can be efficiently produced.

In the injection molding powder production method according to the embodiment, the monomer gas is a reactive gas containing a fluorine-containing group, and the fluorine compound is produced by the plasma polymerization method. According to the plasma polymerization method, it is possible to directly form the dense film 3 on the surface of the metal particle 2 from the monomer gas. As a result, the film 3 that is not easily broken even if the film 3 is thin is obtained. The plasma polymerization method is also useful in that formation efficiency of the film 3 is high.

2.2.3. Sol-Gel Method

The sol-gel method is a method in which a film is formed by polymerization of a fluorine compound precursor.

Examples of the fluorine compound precursor include a coupling agent containing a fluorine atom and a metal alkoxide containing a fluorine atom. Examples of the metal alkoxide include a silicon alkoxide. Among these, the coupling agent containing a fluorine atom is preferably used since the coupling agent enables a stable reaction.

The coupling agent containing a fluorine atom is a compound having a fluorine-containing group and 1 to 3 hydrolyzable groups.

Examples of the fluorine-containing group include a fluoroalkyl group, a perfluoroalkyl group, a fluoroaryl group, and a perfluoroaryl group. Specific examples thereof include the following organic groups.

$F(CF_2)_u$—

$(CF_3)_2CF(CF_2)_v$—

$CF_3(CF_2)_2O(CF(CF_3)CF_2O)_wCF(CF_3)$—

$F(CF_2)_{u-1}O(CF_2)_2$—

$CF_3(CF_2)_2O(CF(CF_3)CF_2)_{w+1}O(CF_2)_2$—

In the organic groups, u is 1 to 21, v is 0 to 18, and w is 1 to 5. In addition, in the organic groups, fluorine atoms may be partially substituted with a hydrogen atom or a chlorine atom.

In addition, in the case of the linear perfluoroalkyl group ($F(CF_2)_u$—), in particular, u is preferably 4 to 12, and more preferably 6 to 10. Accordingly, chemical stability of the coupling agent can be improved.

Examples of the hydrolyzable group include an alkoxy group, an acyloxy group, an aryloxy group, an aminooxy group, an amide group, a ketoxime group, an isocyanate group, and a halogen atom. Among these, the alkoxy group is preferably used.

Examples of the coupling agent include a silane coupling agent, a titanium coupling agent, an aluminum coupling agent, and a zirconium coupling agent, and particularly, the silane coupling agent is preferably used.

In addition, examples of the metal alkoxide containing a fluorine atom include trifluoropropyltrimethoxysilane, nonafluorohexyltrimethoxysilane, and heptadecafluorodecatrimethoxysilane.

The metal alkoxide is preferably monofunctional, bifunctional, or trifunctional, and more preferably bifunctional or trifunctional. Here, for example, "bifunctional" means that the number of alkoxide groups is 2 moles per mole of the metal alkoxide.

Such a fluorine compound precursor and the metal powder are dispersed in a dispersion medium to prepare a dispersion. Examples of the dispersion medium include lower alcohols such as ethanol and methanol, and fluorine-based liquids such as Fluorinert (registered trademark), and the fluorine-based liquid is preferably used so as to uniformly disperse the fluorine compound precursor. A used amount of the dispersion medium with respect to 1 part by mass of the fluorine compound precursor is, for example, 10 parts by mass or more and 50 parts by mass or less. In addition, an addition amount of the fluorine compound precursor added to 1 part by mass of the metal powder is, for example, about 0.01 parts by mass or more and 0.1 parts by mass or less.

Instead of the method for preparing the dispersion, a method for bringing a mixture of the fluorine compound precursor and the dispersion medium into contact with a soft magnetic powder may be used.

Next, a pH of the dispersion is adjusted and then the dispersion is stirred. The pH is adjusted to 9 to 13, for example. An alkaline solution such as aqua ammonia or a sodium hydroxide aqueous solution can be used as a pH adjusting agent. With the stirring, hydrolysis occurs in the hydrolyzable group of the fluorine compound precursor, and the hydrolyzable group is converted into, for example, silanols. The silanols obtained by conversion react with each other and cause dehydration, thereby forming the film 3.

Before or after the alkaline solution is mixed, an ultrasonic wave may be emitted thereto. By performing such ultrasonic irradiation, uniform dispersion of the metal powder can be promoted, and the film 3 can be formed more uniformly on the particle surface. In addition, an order in which the alkaline solution is added is not limited to the above order, and timing of the addition may be different.

Further, after the film 3 is formed, the obtained injection molding powder may be subjected to a heat treatment as necessary. Conditions in the heat treatment are, for example, a temperature of 60° C. or higher and 120° C. or lower and a time of 10 minutes or longer and 300 minutes or shorter. Accordingly, a hydrate remaining on the film 3 can be removed and thus adhesion of the film 3 can be improved.

As described above, the injection molding powder production method according to the embodiment includes the film forming step S104 in which the sol-gel method is used. In the film forming step S104 according to the embodiment, the metal powder and the fluorine compound precursor are mixed to polymerize the fluorine compound precursor on the particle surface of the metal powder (the surface of the metal particle 2), thereby generating the fluorine compound. Accordingly, the film 3 is formed, and the injection molding powder 1 is produced.

According to such a production method, since the sol-gel method is used, the film 3 that has a high coverage and a high density can be formed by self-assembly of the fluorine compound precursor. Therefore, the film 3 that is not easily broken even being thin is obtained.

The fluorine compound precursor is, for example, the coupling agent containing the fluorine-containing group. When such a coupling agent is used, bonding occurs between the hydrolyzable group and the hydroxy group present on the surface of the metal particle 2, and thus it is possible to form the film 3 that has a high density and a uniform thickness. In addition, by using the fluorine-containing group as the functional group, the oil repellency can be easily controlled. Therefore, it is possible to obtain the injection molding powder 1 capable of achieving both the shape retainability necessary for the molded body and the fluidity necessary for the compound at a higher level.

The fluorine compound precursor is, for example, the metal alkoxide containing the fluorine-containing group. When such a metal alkoxide is used, the metal alkoxide subjected to the hydrolysis causes a dehydration reaction with the surface of the metal particle 2, and thus it is possible to form the film 3 that has a high density and a uniform thickness. In addition, such a sol-gel method is convenient in that a special device or chemical is not required.

3. Metal Sintered Compact Production Method

Next, the metal sintered compact production method according to the embodiment will be described.

Figure 3:
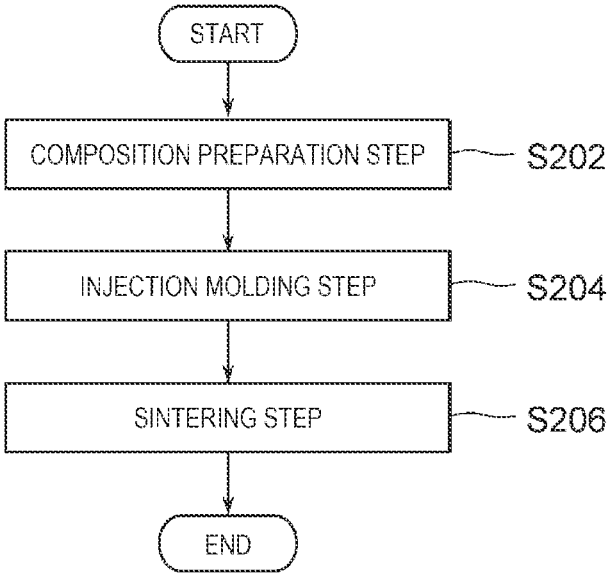
FIG. 3 is a process diagram showing a metal sintered compact production method according to the embodiment.

FIG. 3 is a process diagram showing the metal sintered compact production method according to the embodiment.

The metal sintered compact production method shown in FIG. 3 includes a composition preparation step S202, an injection molding step S204, and a sintering step S206.

3.1. Composition Preparation Step

In the composition preparation step S202, the injection molding powder 1 and an organic binder are mixed to prepare an injection molding composition.

Examples of the organic binder include various thermoplastic resins such as general-purpose plastics, engineering plastics, and super engineering plastics. Examples of the general-purpose plastics include a polyethylene (PE), a polypropylene (PP), polyvinyl chloride (PVC), polyvinylidene chloride (PVDC), a polystyrene (PS), polyvinyl acetate (PVAc), polytetrafluoroethylene (PTFE), an acrylonitrile-butadiene-styrene resin (ABS resin), a styrene-acrylonitrile copolymer (AS resin), and an acrylic resin (PMMA). Examples of the engineering plastics include a polyamide (PA), a polyacetal (POM), a polycarbonate (PC), a modified polyphenylene ether (m-PPE, modified PPE, PPO), polybutylene terephthalate (PBT), polyethylene terephthalate (PET), a syndiotactic polystyrene (SPS), and a cyclic polyolefin (COP). Examples of the super engineering plastics include a polyphenylene sulfide (PPS), polytetrafluoroethylene (PTFE), a polysulfone (PSF), a polyethersulfone (PES), an amorphous polyarylate (PAR), polyetheretherketone (PEEK), a thermoplastic polyimide (PI) a polyamideimide (PAI), and a thermoplastic polyurethane (TPU). One or a mixture of two or more of these resins is used as the organic binder.

For example, various mixers can be used for the mixing. Thereafter, the injection molding composition may be kneaded and compounded as necessary. The compound may be molded in a form of pellets or filaments depending on a type of the injection molding method.

3.2. Injection Molding Step

In the injection molding step S204, the injection molding composition is subjected to injection molding to obtain an injection molded body. As described above, the injection molding includes metal powder injection molding (MIM), fused deposition modeling (metal FDM) using a metal powder, or the like.

3.3. Sintering Step

In the sintering step S206, the injection molded body is subjected to a sintering treatment. Accordingly, a metal sintered compact is obtained.

The sintering treatment is a treatment in which the particles of the metal powder are sintered by heating the injection molded body. An example of a heating condition is a temperature of 980° C. or higher and 1600° C. or lower and a time of 0.2 hours or longer and 24 hours or shorter. Examples of a heating atmosphere include an air atmosphere, an inert gas atmosphere, and a reduced pressure atmosphere.

In addition, prior to the sintering treatment, the injection molded body may be subjected to a debindering treatment. The debindering treatment is a treatment of removing at least a part of the organic binder by heating the injection molded body.

The obtained metal sintered compact is used as all or a part of, for example, transportation equipment parts such as automobile parts, bicycle parts, railroad vehicle parts, ship parts, aircraft parts, and space transportation parts, electronic device parts such as personal computer parts, mobile phone terminal parts, tablet terminal parts, and wearable terminal parts, parts for electrical equipment such as refrigerators, washing machines, and air conditioners, machine parts such as machine tools and semiconductor production devices, parts for plants such as nuclear power plants, thermal power plants, hydropower plants, refineries, and chemical complexes, watch parts, metal tableware, and ornaments such as jewelry and eyeglass frames.

As described above, the metal sintered compact production method according to the embodiment includes the composition preparation step S202, the injection molding step S204, and the sintering step S206.

In the composition preparation step S202, the injection molding powder 1 and the organic binder are mixed to prepare the compound (injection molding composition). In the injection molding step S204, the compound is subjected to the injection molding to obtain the injection molded body. In the sintering step S206, the injection molded body is subjected to the sintering treatment.

According to such a configuration, since the fluidity of the compound is high and the used amount of the organic binder is reduced, it is possible to reduce the shrinkage amount due to debindering in the injection molded body. Accordingly, a metal sintered compact having high dimensional accuracy is obtained.

The injection molding powder, the injection molding powder production method, and the metal sintered compact production method according to the present disclosure are described above based on preferred embodiments, but the present disclosure is not limited thereto. For example, the injection molding powder production method and the metal sintered compact production method according to the present disclosure may be a method in which a step for any purpose is added to the above-described embodiment.

EXAMPLES

Next, specific Examples of the present disclosure will be described.

4. Preparation of Injection Molding Powder

4.1. Example 1

First, a stainless steel SUS316L powder was prepared by a water atomization method. A particle size distribution on a volume basis of the obtained metal powder was obtained by a laser diffraction scattering particle size distribution measuring device. Then, an average particle diameter was calculated based on the obtained particle size distribution. Calculation results are shown in Table 1.

Next, the obtained metal powder was subjected to an ozone treatment.

Next, 50 mg of trifluoropropyltrimethoxysilane as a fluorine compound precursor was diluted 10 times by mass with Fluorinert (registered trademark) so as to prepare a treatment liquid. Then, the obtained treatment liquid was sprayed and brought into contact with 50 g of the metal powder.

Next, the metal powder sprayed with the treatment liquid was stirred while being heated to 100° C., dried, and then gradually cooled to room temperature by natural cooling. As described above, a film was formed on the particle surface of the metal powder by a sol-gel method to obtain an injection molding powder.

4.2. Example 2

An injection molding powder was obtained in the same manner as in Example 1 except that the obtained injection molding powder was subjected to a hydrophilization treatment. A time for the hydrophilization treatment was adjusted such that the contact angle shown in Table 1 was obtained. The hydrophilization treatment was an atmospheric pressure plasma treatment using water vapor as a treatment gas.

4.3. Examples 3 and 4

An injection molding powder was obtained in the same manner as in Example 2 except that the time for the hydrophilization treatment was changed.

4.4. Example 5

An injection molding powder was obtained in the same manner as in Example 1 except that production conditions for the injection molding powder were changed as shown in Table 1.

4.5. Example 6

An injection molding powder was obtained in the same manner as in Example 2 except that the time for the hydrophilization treatment was changed.

4.6. Example 7

An injection molding powder was obtained in the same manner as in Example 5 except that the production conditions for the injection molding powder were changed as shown in Table 1.

4.7. Example 8

An injection molding powder was obtained in the same manner as in Example 1 except that production conditions for the injection molding powder were changed as shown in Table 1.

4.8. Comparative Example 1

An injection molding powder was obtained in the same manner as in Example 1 except that the formation of the film was omitted.

4.9. Comparative Examples 2 to 4

An injection molding powder was obtained in the same manner as in Example 1 except that the obtained injection molding powder was subjected to a hydrophilization treatment. A time for the hydrophilization treatment was adjusted such that the contact angle shown in Table 1 was obtained. The hydrophilization treatment was an atmospheric pressure plasma treatment using water vapor as a treatment gas.

Symbols of fluorine compound precursors shown in Table 1 correspond to the following substance names.

A-1: trifluoropropyltrimethoxysilane

A-2: nonafluorohexyltrimethoxysilane

A-3: heptadecafluorodecatrimethoxysilane 4.10. Example 9

An injection molding powder was obtained in the same manner as in Example 1 except that the film was formed on the particle surface of the metal powder by a plasma polymerization method. A gas shown in Table 2 was used as a monomer gas, i.e., a raw material. In addition, an argon gas was used as a discharge gas.

4.11. Examples 10 and 11

An injection molding powder was obtained in the same manner as in Example 9 except that the obtained injection molding powder was subjected to a hydrophilization treatment. A time for the hydrophilization treatment was adjusted such that the contact angle shown in Table 2 was obtained. The hydrophilization treatment was an atmospheric pressure plasma treatment using water vapor as a treatment gas.

4.12. Examples 12 and 13

An injection molding powder was obtained in the same manner as in Example 1 except that the film was formed on the particle surface of the metal powder by a mechanochemical method. Fluororesin powders shown in Table 2 were used as a fluorine compound powder, i.e., a raw material. The fluororesin powder had an average particle diameter of 6 μm.

4.13. Comparative Example 5

An injection molding powder was obtained in the same manner as in Example 1 except that the film was formed on the particle surface of the metal powder by a mechanochemical method. As a raw material, a polypropylene powder, i.e., a resin powder not containing fluorine, was used. The PP powder had an average particle diameter of 5 μm.

5. Evaluation of Injection Molding Powder 5.1. Contact Angle

The injection molding powder in each of Examples and Comparative Examples was laid in layers on a double-sided tape. Next, a contact angle of hexadecane with respect to the injection molding powder was measured by a θ/2 method using a contact angle measuring device. Measurement results are shown in Tables 1 and 2.

5.2. Average Thickness of Film

A particle cross section of the injection molding powder in each of Examples and Comparative Examples was observed with an electron microscope. Then, an average thickness of the film was calculated based on an observation result. Calculation results are shown in Tables 1 and 2.

5.3. Coverage

A coverage of the film of the injection molding powder in each of Examples and Comparative Examples was calculated by the method described above. Calculation results are shown in Tables 1 and 2.

5.4. Area Ratio of Fluorine-Derived Peak Detected by XPS Method

The injection molding powder in each of Examples and Comparative Examples was subjected to elemental analysis by the XPS method. Then, the area ratio of an F1s peak to a total peak area was calculated based on an analysis result. Calculation results are shown in Tables 1 and 2.

5.5 Rate of Change in Viscosity with Respect to Amount of Change in Shear Rate

The injection molding powder in each of Examples and Comparative Examples was mixed with a polystyrene. Then, the viscosity of the obtained mixture was measured with a rheometer while changing a shear rate applied to the mixture. Next, a flow curve indicating a change in viscosity with respect to a change in shear rate was acquired. Then, a rate of change in viscosity [Pa·s] when the shear rate was increased from 0.5 [l/s] to 500 [l/s] was calculated. Calculation results are shown in Tables 1 and 2.

5.6. Viscosity at High Shear Rate

For the injection molding powders in Examples and Comparative Examples, viscosities at a high shear rate (500 [l/s]) acquired by the evaluation performed in 5.5 were compared. Next, when the viscosity acquired at the high shear rate for the injection molding powder in Comparative Example 1 was defined as 1, a relative value of the viscosity acquired at the high shear rate for the injection molding powder in each of Examples and Comparative Examples was calculated. Then, the calculated relative value was evaluated in light of the following evaluation criteria.

A: The relative value is less than 0.1.

B: The relative value is 0.1 or more and less than 0.4.

C: The relative value is 0.4 or more and less than 0.7.

D: The relative value is 0.7 or more and less than 1.0.

E: The relative value is 1.0 or more.

Evaluation results are shown in Tables 1 and 2.

TABLE 1

| | Production condition for injection molding powder | | | Evaluation of injection molding powder | | | | | |
|---|---|---|---|---|---|---|---|---|---|
| | Metal powder | Film | | | | | | | |
| | Average particle diameter μm | Fluorine compound precursor — | Molding method — | Contact angle ° | Average thickness of film μm | Coverage of film % | Area ratio of F1s peak % | Change in viscosity — | Viscosity at high shear rate — |
| Example 1 | 7 | A-1 | Sol-gel method | 90 | 25 | 70 | 45 | 1.0 | A |
| Example 2 | 7 | A-1 | Sol-gel method | 81 | 20 | 65 | 40 | 0.6 | B |
| Example 3 | 7 | A-1 | Sol-gel method | 75 | 30 | 75 | 30 | 0.4 | B |
| Example 4 | 7 | A-1 | Sol-gel method | 63 | 24 | 70 | 25 | 0.2 | C |
| Example 5 | 7 | A-2 | Sol-gel method | 94 | 18 | 50 | 50 | 1.5 | A |
| Example 6 | 7 | A-2 | Sol-gel method | 91 | 5 | 50 | 48 | 1.2 | A |
| Example 7 | 10 | A-2 | Sol-gel method | 86 | 45 | 80 | 42 | 1.1 | B |
| Example 8 | 5 | A-3 | Sol-gel method | 96 | 25 | 70 | 65 | 2.0 | A |
| Comparative Example 1 | 7 | — | — | 15 | — | — | 0 | 0.02 | E |
| Comparative Example 2 | 7 | A-1 | Sol-gel method | 50 | 26 | 70 | 45 | 0.10 | D |
| Comparative Example 3 | 7 | A-2 | Sol-gel method | 53 | 25 | 65 | 50 | 0.11 | D |
| Comparative Example 4 | 7 | A-3 | Sol-gel method | 56 | 32 | 75 | 65 | 0.12 | D |

TABLE 2

| | Production condition for injection molding powder | | | Evaluation of injection molding powder | | | | | |
|---|---|---|---|---|---|---|---|---|---|
| | Metal powder | | | | | | | | |
| | Average | Film | | | Average | | Area | Change | Viscosity |
| | particle diameter μm | Raw material — | Molding method — | Contact angle ° | thickness of film μm | Coverage of film % | ratio of F1s peak % | in viscosity — | at high shear rate — |
| Example 9 | 7 | $C_4F_8$ gas | Plasma polymerization method | 88 | 15 | 70 | 45 | 1.0 | A |

TABLE 2-continued

| | Production condition for injection molding powder | | | Evaluation of injection molding powder | | | | | |
|---|---|---|---|---|---|---|---|---|---|
| | Metal powder | Film | | | | | | | |
| | Average particle diameter μm | Raw material — | Molding method — | Contact angle ° | Average thickness of film μm | Coverage of film % | Area ratio of F1s peak % | Change in viscosity — | Viscosity at high shear rate — |
| Example 10 | 7 | $C_4F_8$ gas | Plasma polymerization method | 73 | 20 | 65 | 40 | 0.6 | B |
| Example 11 | 7 | $C_4F_8$ gas | Plasma polymerization method | 65 | 28 | 75 | 30 | 0.3 | C |
| Example 12 | 7 | PTFE powder | Mechanochemical method | 98 | 25 | 75 | 45 | 2.0 | A |
| Example 13 | 7 | PFA powder | Mechanochemical method | 96 | 25 | 70 | 48 | 1.5 | A |
| Comparative Example 5 | 7 | PP powder | Mechanochemical method | 49 | 30 | 70 | 0 | 0.10 | D |

As shown in Tables 1 and 2, the viscosity when a shear force is applied to the mixture of the injection molding powder in each of Examples with a polystyrene at a high shear rate is lower than the viscosity when a shear force is applied to the mixture of the injection molding powder in each of Comparative Examples with a polystyrene at a high shear rate. That is, it is confirmed that the injection molding powder in each of Examples can implement a compound exhibiting high fluidity during the injection molding. From this result, it is considered that the used amount of the organic binder can be reduced in order to implement the same fluidity. Therefore, according to the injection molding powder of the present disclosure, it is confirmed that the used amount of the binder to be added to the compound can be reduced while securing the fluidity of the compound.

In addition, the rate of change in viscosity of the mixture of the injection molding powder in each of Examples with a polystyrene is larger than the rate of change in viscosity of the mixture of the injection molding powder in each of Comparative Examples with a polystyrene.

Figure 4:
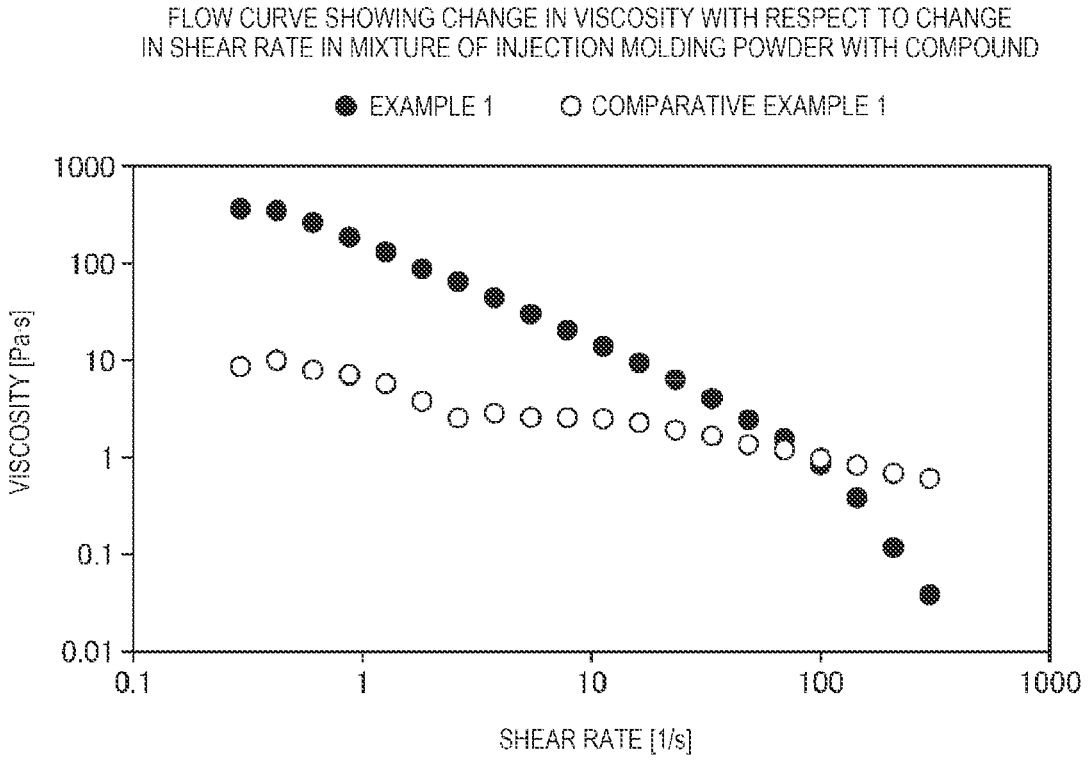
FIG. 4 is a flow curve showing a change in viscosity with respect to a change in shear rate when a shear rate is applied to a mixture of an injection molding powder in Example 1 with a polystyrene and a mixture of an injection molding powder in Comparative Example 1 with a polystyrene.

FIG. 4 is a flow curve showing the change in viscosity with respect to the change in shear rate when the shear rate is applied to a mixture of the injection molding powder in Example 1 with a polystyrene and a mixture of the injection molding powder in Comparative Example 1 with a polystyrene.

As shown in FIG. 4, the flow curve obtained for the injection molding powder in Comparative Example 1 has a gentle slope. On the other hand, the flow curve obtained for the injection molding powder in Example 1 has a steep slope. That is, in the latter, the rate of change in viscosity with respect to the change in shear rate is larger than that in the former. Therefore, it has been found that the compound containing the latter powder can improve the fluidity during the injection molding while improving the shape retainability during molding.

In the flow curve shown in FIG. 4, a result is also obtained that the viscosity at a low shear rate obtained for the injection molding powder in Example 1 is higher than the viscosity at a low shear rate obtained for the injection molding powder in Comparative Example 1. From this result, it is considered that the compound containing the injection molding powder in Example 1 behaves in a solid state at a low shear rate and exhibits a high viscosity. On the other hand, it is considered that the compound containing the injection molding powder in Example 1 exhibits high responsiveness to an external force due to an effect of the film containing the fluorine compound at a high shear rate, thereby decreasing the viscosity.

On the other hand, the compound containing the injection molding powder in Comparative Example 1 behaves in a liquid state even at a low shear rate and exhibits a low viscosity. In addition, it is considered that even if the shear rate is increased thereafter, the liquid behavior does not greatly change. For this reason, it is considered that the decrease in viscosity is limited in the flow curve of Comparative Example 1 shown in FIG. 4.

What is claimed is:

1. An injection molding powder comprising:

a metal powder; and a film with which a particle surface of the metal powder is coated and which contains a compound derived from a nonafluorohexyltrimethoxysilane and a glass material, the glass material being present in an amount up to 30 mass %, wherein a contact angle of hexadecane measured at 25° C. by a θ/2 method is 60° or more and 110° or less in a state in which the injection molding powder is laid in layers.

2. The injection molding powder according to claim 1, wherein an average particle diameter of the metal powder is 3.0 μm or more and 30.0 μm or less.

3. The injection molding powder according to claim 1, wherein a concentration of the fluorine atoms in the film is determined by calculating an area ratio of an F1s peak detected by conducting an X-ray photoelectron spectroscopy (XPS) method of the film, the area ratio of the F1s peak being 10% or more and 75% or less of a total peak area.

4. The injection molding powder according to claim 1, wherein the film is a hydrophilically-treated film including a hydroxy group.

5. A metal sintered compact production method comprising:

mixing the injection molding powder according to claim 1 and an organic binder to prepare an injection molding composition;

subjecting the injection molding composition to injection molding to obtain an injection molded body; and subjecting the injection molded body to a sintering treatment.

* * * * *